US006364127B1

(12) United States Patent
Richardson

(10) Patent No.: US 6,364,127 B1
(45) Date of Patent: Apr. 2, 2002

(54) METHOD AND APPARATUS FOR A SPRING TENSIONED DISPLAY DEVICE

(76) Inventor: Edward Richardson, 591 Campus Pl., Baldwin, NY (US) 11510

( * ) Notice: Subject to any disclaimer, the term of this patent is extended or adjusted under 35 U.S.C. 154(b) by 0 days.

(21) Appl. No.: 09/307,639

(22) Filed: May 7, 1999

(51) Int. Cl.[7] ..... A47F 7/00
(52) U.S. Cl. ..... 211/14; 211/89.01; D6/552
(58) Field of Search ..... 211/14, 89.01; 206/315.9, 315.91, 315.1; D6/552

(56) References Cited

U.S. PATENT DOCUMENTS 225,530 A * 3/1880 McGlinchy ..... 211/14
3,559,935 A * 2/1971 Gardner ..... 211/14

* cited by examiner

*Primary Examiner*—Robert W Gibson, Jr.

(74) *Attorney, Agent, or Firm*—Ward & Olivo

(57) ABSTRACT

The present invention relates in general display devices, and more specifically, provides a method and apparatus for a spring tensioned golf ball display and showcase. Specifically, described herein is a golf ball display mechanism comprising at least two bases, one having a stationary holding member and the other having a spring loaded holding member. The spring loaded member is loosely inserted into the first base and preferrably has a wooden compressor at its end positioned adjacent to a coil spring. The second member is firmly affixed within a second base. These bases are intended to be positioned opposite each other such that the member are axially opposed. Therefore, when the spring loaded member is depressed, the space between the two members is widened in order to insert the item to be displayed. Once the item is in position, the spring loaded member is released, thereby securely holding the item in place and on display. By stacking the devices side-by-side or one on top of the other, this display device can be used in any number of forms, such as the base of a lamp.

14 Claims, 4 Drawing Sheets

METHOD AND APPARATUS FOR A SPRING TENSIONED DISPLAY DEVICE

TECHNICAL FIELD OF THE INVENTION

The present invention relates in general to display device for displaying objects. More specifically, the invention provides a method and apparatus for a spring tensioned golf ball display and showcase. In particular, the display according to the present invention displays multiple golf balls (or other objects), either vertically or horizontally, by means of a spring loaded golf tee opposite from a fixed golf tee (of course, members similar to the golf tees may also be used) positioned at each displayed golf ball (or other object).

BACKGROUND OF THE INVENTION

It is quite common and desirable to display various objects of achievement, such as diplomas, certificates, etc. Similarly, achievements in athleics sometimes are represented by the "game ball" or an item with particular markings to reflect its origin and importance. Quite often it is highly desirable to disply these objects of achievement in an aesthetic manner. Display devices for such purpose as displaying athletic or related items such as soccer balls, volleyballs, baseballs, etc., are well known in the prior art. For example:

U.S. Pat. No. 4,494,650, issued on Jan. 24, 1993, to John F. Cullen, discloses an improved display package for a soccer ball, volleyball, baseball and the like. It has two body members which are cooperatively engageable through the use of snap means located on each respective circumferential shoulder member. It has two body members, engageable through the use of snap means, and does not use a spring loaded mechanism.

U.S. Pat. No. 4,955,485, issued on Sep. 14, 1994, to Forrest W. Alton, discloses a modular display device that in a free standing configuration can be bent through various angles. It is used to display a series of autographed balls in a shelf like structure. The modular display device of this patent does not uses a spring loaded holder.

U.S. Pat. No. 5,377,829, issued on Jan. 3, 1995, to Ronald J. Bahl, discloses displaying footballs in a case featuring a frame with four dowels in the vertical position which support a football, and does not disclose use of a spring loaded support system.

U.S. Pat No. 5,118,171, issued on Jun. 5, 1996 to Sigifredo Ortiz, discloses a display which is particularly useful for mounting and attractively displaying an article of headgear along with memorabilia related to the headgear.

U.S. Pat. No. 5,624,325, issued on Apr. 29, 1997, to Michael Smith, discloses a golf ball teeing apparatus for teeing up a series of golf balls on a practice tee, a container for holding the golf balls and a dispensing mechanism for delivering the balls from the container to the driving tee.

U.S. Pat. No. 5,494,202, issued on Feb. 27, 1996, to Sammy Wyatt, discloses a golf accessory holder of a generally rectangular shaped housing for holding one or more golf balls, golf tees and other golf accessories. It is does not employ a spring loaded holding mechanism and is not used for holding display items like golf balls.

U.S. Pat. No. 5,522,594, issued on Jun. 4, 1996, to Ray H. Taylor, discloses a golf club for impelling a golf ball without swinging. The golf club is prepared for use by inserting an explosive charge and cocking the firing mechanism. It does not disclose any display function.

U.S. Pat. No. 5,096,200, issued on Mar. 17, 1992, to Schuichi, Matsushita, discloses an automatic golf ball dispenser which dispenses golf balls to a tee for driving or directly to a mat for iron shots. However, nothing disclosed in this patent can be used for displaying items.

U.S. Pat. No. 5,613,678, issued on Mar. 25, 1997, to Mckee, et al., discloses means for projecting supported objects, such as baseballs, footballs, golf balls, etc., suitable for use in children's games. Nothing therein teaches or suggests the display of such items the way the present invention does.

Prior to the device of the present invention, there was no secure way to hold golf balls or other athletic items during display or while moving the display piece. The present invention has substantially fulfilled this need.

SUMMARY OF THE INVENTION

In view of the foregoing disadvantages inherent in the known types of display members of athletic related items in the prior art, the present invention provides a new means for display such items. The present invention provides a spring loaded mechanism which can securely hold golf balls in place during display, or while moving your display piece. The mechanism can be used in lamp form, shelf form or a host of other different display types whichever is the most meaningful or suitable to the individual circumstance.

The mechanism comprises two ball holder showcase portions, each having a golf ball tee attached thereto, one of which being spring loaded. Preferably, each golf ball tee is inserted into a ball holder's showcase. When the spring loaded golf ball tee is compressed, it creates a space large enough to insert a golf ball. The spring loaded golf tee is then released, locking the golf ball in place between the two golf tees. This invention allows one to display the golf balls or athletic items in multiple stacks, in pyramid form, or in any arrangement as one desires.

Also, the ball holder's showcase portions can be of any color. One can choose the color most suitable with the background of the display, or the color that enhances the effect of the display the most. Moreover, the ball holder's showcase portions can be constructed of any number of materials. Hardwood, such as oak or maple, is recommended because they are traditionally preferred material in supporting display objects. Plastics or composite materials can also be used.

It is to be understood that the invention is not limited in its application, details of construction, or to the arrangements of the shape of the mechanism in the following description or illustrated in the drawings. The invention is capable of other embodiments and of being practiced and carried out in various ways. This disclosure may be utilized as a basis for the designing of other structures, methods and arrangement for the purpose of display.

OBJECTS OF THE INVENTION

It is an object of the present invention to provide a new and improved device to display athletic items and in particular golf balls.

Another object of the invention is to provide a display device that can securely hold the display item in place during display or while moving the display pieces.

A further object of the present invention is to provide a display device that can be readily expanded as the collection of items being stored and displayed increases.

An even further object of the present invention is to provide a display device that is convenient in that it can be assembled easily without any tools.

Still yet another object of the present invention is to provide a display device that is versatile in that it can be in any shape or form to satisfy a variety of special desires.

The present invention will be better understood and objects other than those set forth above will become apparent when considered in view of the drawings and detailed description provided below.

BRIEF DESCRIPTION OF THE DRAWINGS

A further understanding of the present invention can be obtained by reference to a preferred embodiment set forth in the illustrations of the accompanying drawings. Although the illustrated embodiment is merely exemplary of systems for carrying out the present invention, both the organization and method of operation of the invention, in general, together with further objectives and advantages thereof, may be more easily understood by reference to the drawings and the following description. The drawings are not intended to limit the scope of this invention, which is set forth with particularity in the claims as appended or as subsequently amended, but merely to clarify and exemplify the invention.

For a more complete understanding of the present invention, reference is now made to the following drawings in which.

DETAILED DESCRIPTION OF INVENTION

As required, a detailed illustrative embodiment of the present invention is disclosed herein. However, techniques, systems and operating structures in accordance with the present invention may be embodied in a wide variety of forms and modes, some of which may be quite different from those in the disclosed embodiment. Consequently, the specific structural and functional details disclosed herein are merely representative, yet in that regard, they are deemed to afford the best embodiment for purposes of disclosure and to provide a basis for the claims herein which define the scope of the present invention.

The following presents a detailed description of a preferred embodiment of the present invention. As discussed above, the present invention relates generally to display devices, and more particularly to a display device for golf balls. Specifically, the present invention provides a method and apparatus for displaying golf balls or other types of memorabilia in a simple, yet secure manner, while also preserving the aesthetics surrounding the display. Reference is herein made to the figures, wherein the numerals representing particular parts are consistently used throughout the figures and accompanying discussion.

Figure 1:
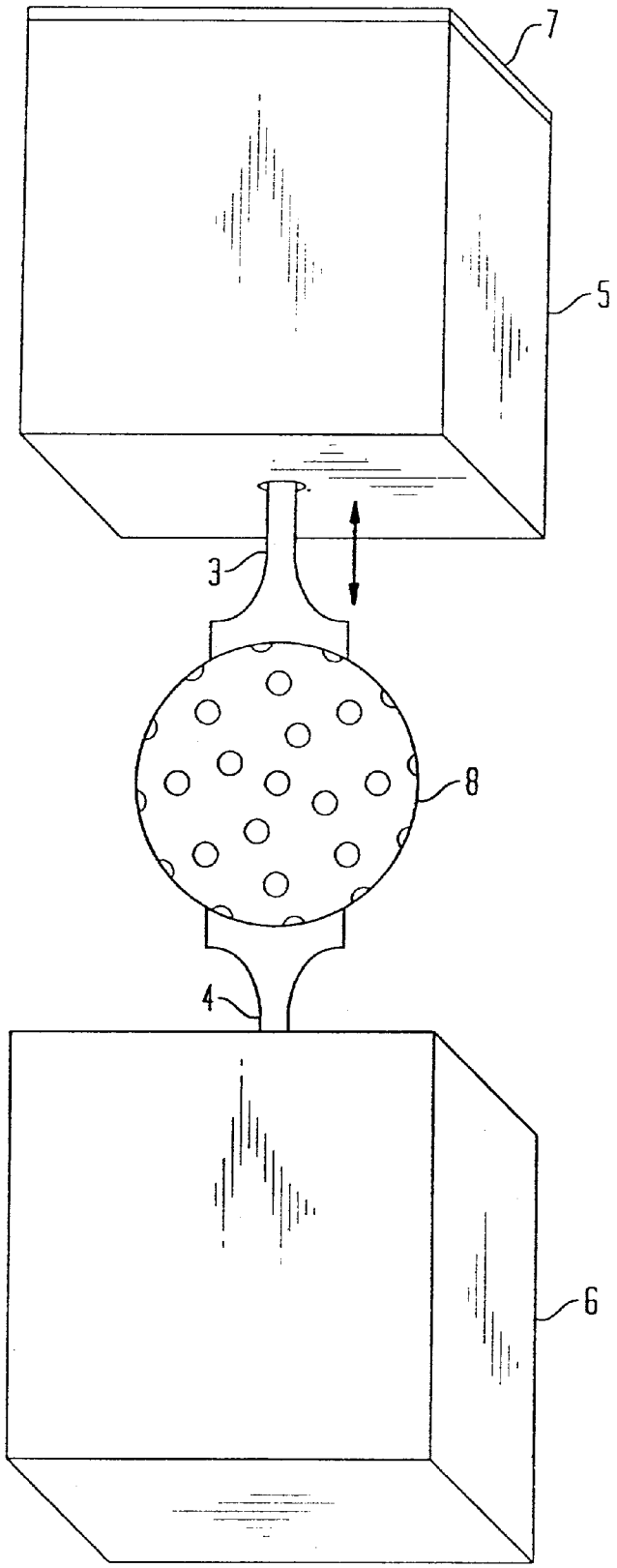
FIG. 1 depicts a front elevational view of the present invention showing a single golf ball being held in place by two golf ball tees.

With reference first to FIG. 1, shown is a diagram of a single representation of the invention. In general, this invention utilizes the compressible feature of coil springs. When a coil spring is pressed to a desired level, it creates space large enough to insert a display object. On the other hand, when a spring coil is released, it creates force which pushes down the thing connected with it and thereby secures a display object in the place. This invention includes bases 5, 6, cover 7 for base 5, coil spring 1, wooden spring compressor 2 inside show case 5, golf tee 3 and 4 to hold golf ball 8.

Base 5 has two adjoining holes, hole 9 and hole 10. Hole 9 is to insert coil spring 1 and wooden spring compressor 10. Hole 10 is to insert golf tee 3. Base 6 has hole 11 which is to insert golf tee 4. Golf tee 4 and 3 are exactly opposite each other so that they can hold golf ball 8. To place displayed object, golf ball 8, between golf tee 4 and 3, one presses golf tee 3, which in turn presses wooden spring compressor 2, which compresses coil spring 1. Thereby, the distance between golf tee 3 and golf tee 4 is increased and thus, enables golf ball 8 to be inserted into the space. After golf ball 8 is inserted into the space properly, by releasing golf tee 3, coil spring 1 pushes wooden compressor 2 down which in turn, pushes golf tee 3 down and, therefore, secures the golf ball 8 in place.

Base 5, 6, and cover 7 can be constructed of almost any type of material. Hardwood, such as oak or maple, is recommended because traditionally people like to use hardwood to construct showcases because of its aesthetics and solid structure. Plastics or composite materials can also be used in the construction of the base 5, 6 and cover 7, as long as the material is firm and strong enough to support the displayed items. Bases 5 and 6, and cover 7 can be of any color. One can select the same color for entire bases 5 and 6 and cover 7 or can mix as many colors as one wishes, or any design that one prefers.

Figure 2:
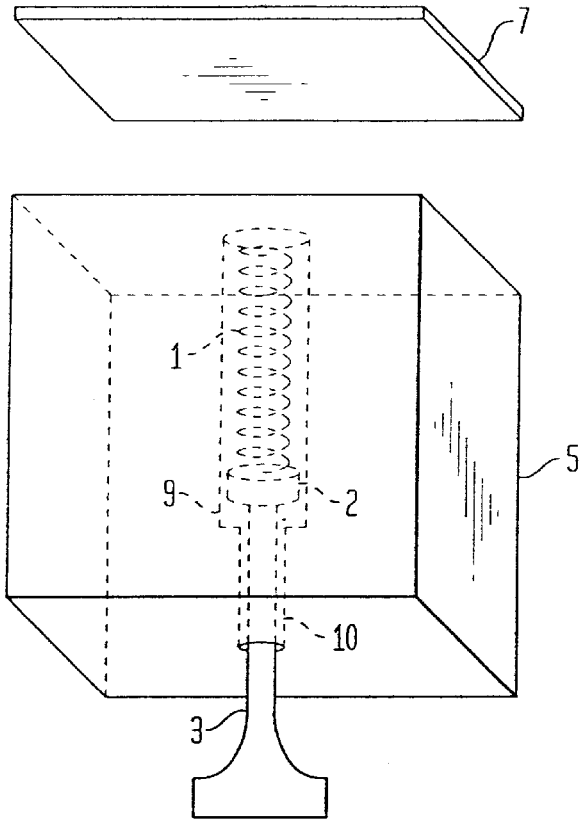
FIG. 2 depicts a front perspective view of the spring portion of the golf ball holder.

FIG. 2 shows the spring mechanism inside base 5. Base 5 has two adjoining holes, hole 9 and hole 10. At the base of hole 9 is inserted a wooden spring compressor 2 which is cut about ¼", thick, but may range between ½" and ⅛" in thickness. The diameter of wooden spring compressor 2 should be approximately the same as the diameter of spring coil 1. The purpose of this is to prevent the wooden spring compressor 2 from falling inside coil spring 1 when it is compressed. After the wooden spring compressor 2 is inserted into hole 9 flat side down, the next component to be inserted into hole 9 is coil spring 1 which then, sits on the spring compressor 2 as shown in FIG. 2. Hole 9 is then covered by cover 7 using the same material used in base 5. If using wood, the cover 7, which is cut at about ⅛" thick, but may be between ¼" and 1/16", can be glued and sanded upon completion. The size of hole 9 must properly fit coil spring 1 and wooden spring compressor 2. In other words, the length of hole 9 must be long enough to keep wooden spring compressor 2 and coil spring 1 inside the base 5; therefore, cover 7 can cover them. Hole 10 must be able to fit the stem of golf tee 3 loosely. Hole 9 and 10 are adjoining holes.

Figure 3:
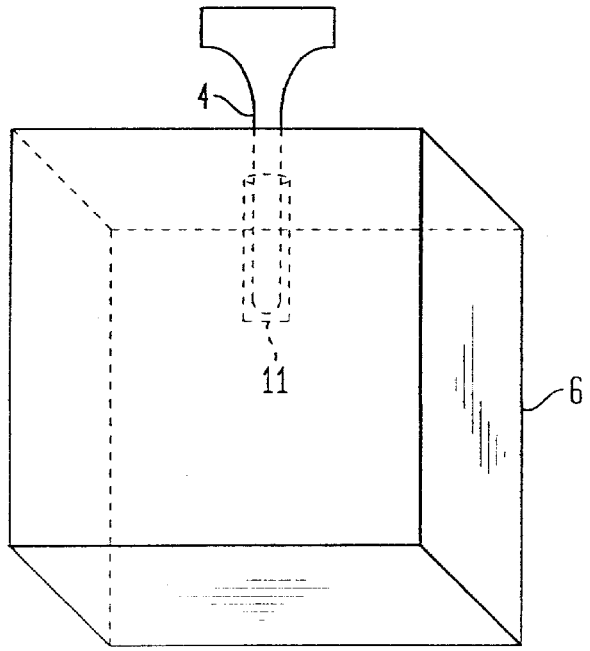
FIG. 3 depicts the front perspective view of the fixed portion of the golf ball holder.

FIG. 3 shows the fixed golf tee 4 portion of the base 6 which has hole 11 to support a tightly fitted golf ball tee 4. Golf tee 4 is cut to length then inserted into hole 11 and tapped into place using a rubber or like mallet.

It is very important that hole 10 and hole 11 are perfectly opposite each other (as shown in FIG. 2 and FIG. 3), during the construction of the base 5 and 6. A wrong alignment of holes 10, 11 will result in the golf ball 8 not resting properly on the golf tees 3, 4. After completing the construction of the golf ball holder FIG. 1, golf ball tee 3 is then cut to size, FIG. 2. Being that the golf ball tee 3 is loosely fitted, it will not remain in hole 10 unless a display object like golf ball 8 is placed upon it and golf tee 4 is properly placed under golf ball 8, as shown in FIG. 1.

Engaging the spring-loaded mechanism in FIG. 2 with the device in FIG. 3, requires that one compresses the golf tee 3 in the spring-loaded portion of the base 5. The compression of golf tee 3 widens the space between golf tee 3 and golf tee 4. In this position, one now can insert a display object such as golf ball 8 between golf tee 3 and 4. Once the golf ball 8 is in proper place, releasing golf tee 3, will secure the golf ball 8 in place.

To remove a display object, golf ball 8 that is locked in between golf tee 3 and 4, simply compress the spring-loaded golf tee 3. This will widen the space between golf tee 3 and 4. While the spring-loaded golf tee 3 is compressed, take out ball 8; then, release the golf tee 3. It is very simple to remove the ball 18 that is locked in between the golf tees 3 and 4. Neither tooling nor reassembling is required.

Figure 4:
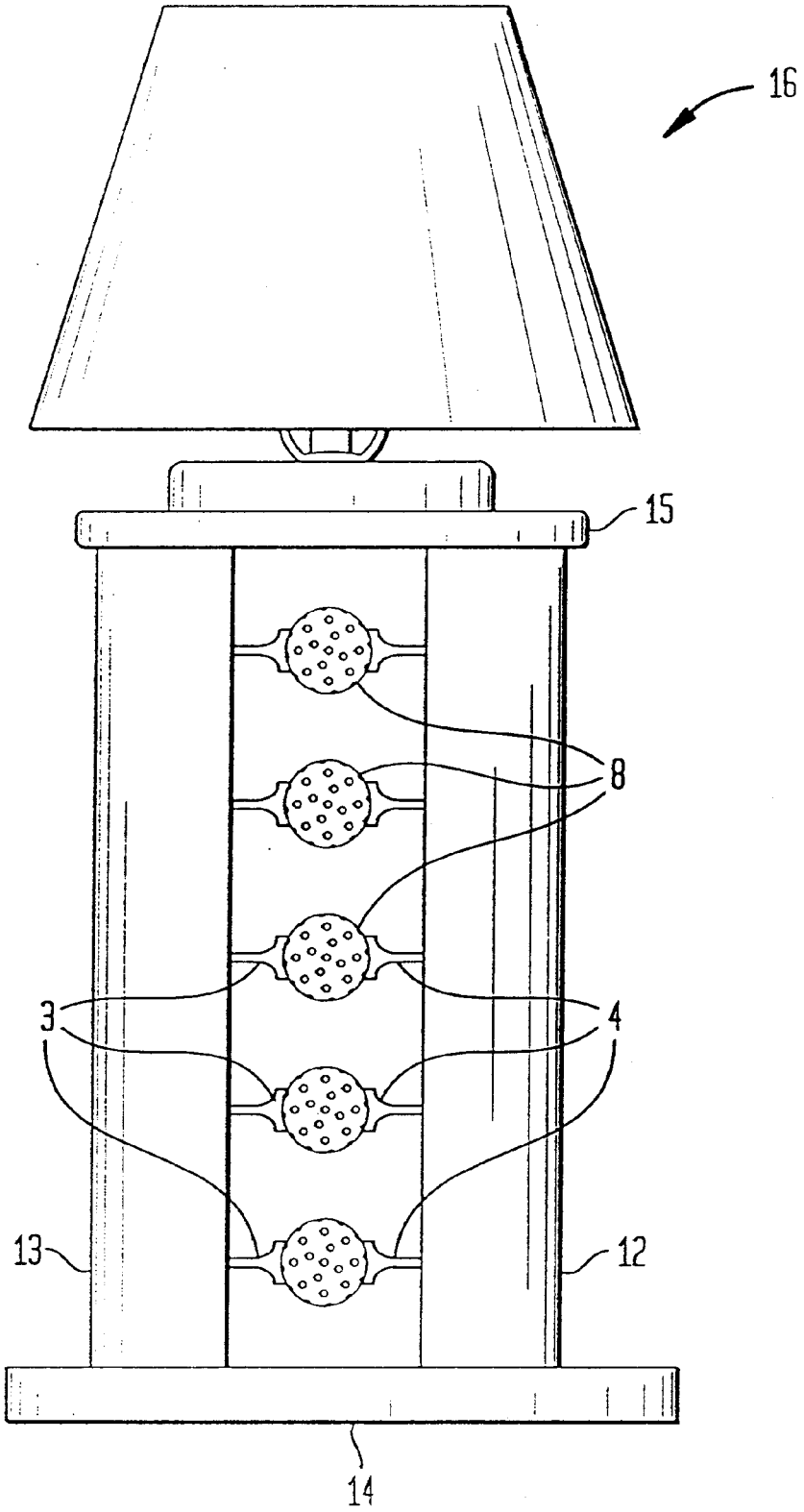
FIG. 4 depicts a front plan view of a vertical display device comprising a plurality of the golf ball holding display devices according to the present invention.
Figure 5:
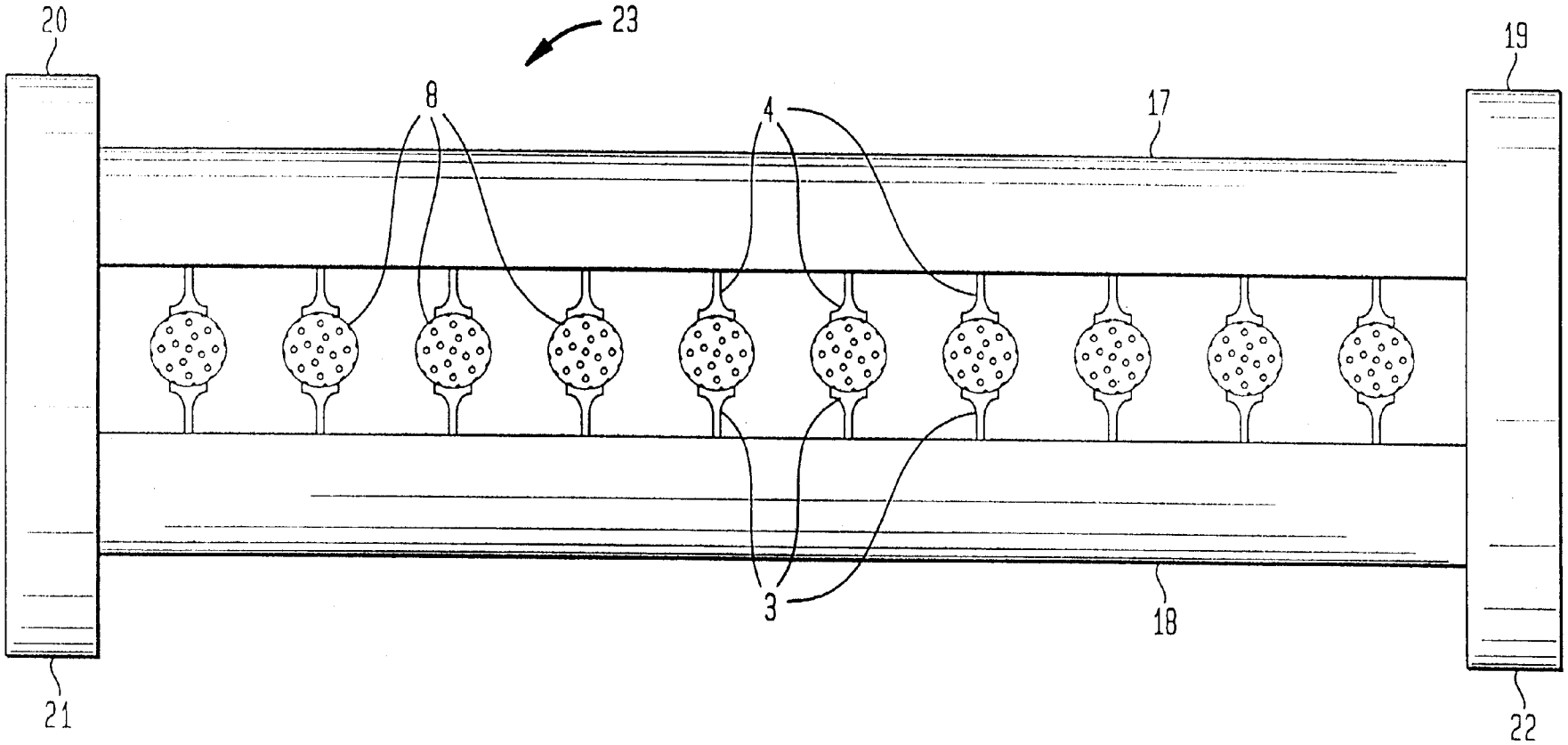
FIG. 5 depicts a front plan view of a horizontal display device comprising a plurality of the golf ball holding display devices according to the present invention.

Turning next to FIGS. 4 & 5, illustrated are front plan views of a vertical display device 16 (in the form of a lamp) and a horizontal display device 23, respectively, each comprising a plurality of the golf ball holding display devices shown in FIG. 1. Specifically, FIG. 4 demonstrates an embodiment of the invention wherein base devices 5,6 are stacked vertically in supports 12,13, respectively, which together with top support 15 and bottom support 14 comprise the support structure of a conventional lamp. As shown, golf balls 8 (or other items to be displayed) are held on display positioned between holding members 3,4. Again, coil spring 1 provides the force needed to secure golf ball 8 on display, while also allowing the golf ball 8 to be removed with ease.

Similarly, FIG. 5 demonstrates an embodiment of the invention wherein base devices 5,6 are aligned vertically in supports 17,18, respectively, which together with left support 20 and right support 19 (each having a base portion 21,22) comprise the support structure of vertical display in accordance with this invention. As shown, golf balls 8 (or other items to be displayed) are held on display positioned between holding members 3,4. Again, coil springs 1 adjacent to holding members 3 provide the necessary force to secure golf balls 8 on display, while also allowing for easy replacement or removal of the golf balls 8.

While the present invention has been described with reference to one or more preferred embodiments, such embodiments are merely exemplary and are not intended to be limiting or represent an exhaustive enumeration of all aspects of the invention. The scope of the invention, therefore, shall be defined solely by the following claims. Further, it will be apparent to those of skill in the art that numerous changes may be made in such details without departing from the spirit and the principles of the invention. It should be appreciated that the display device of the present invention is capable of being embodied in other forms without departing from its essential characteristics.

What is claimed is:

1. An apparatus for displaying items, wherein said apparatus comprises a plurality of first and second support devices, wherein each said first support device includes a first holding member axially positioned therein and each said second support device includes a second holding member axially positioned therein, wherein said first and second holding members are axially opposed to one another for securing said items, and wherein at least one of each said first or second support devices has positioned therein a compression spring adjacent to one end of said first or second holding member.

2. An apparatus according to claim 1, wherein said first holding members apply force to a first side of said items and said second holding member applies force to a second side of said items, wherein said first side is opposite said second side.

3. An apparatus according to claim 1, wherein said first and second holding members comprise golf tees.

4. An apparatus according to claim 1, wherein said apparatus comprises a base of a lamp.

5. An apparatus according to claim 1, wherein said apparatus comprises a plurality of said first and second base devices.

6. An apparatus according to claim 1, wherein said support devices are positioned in parallel.

7. An apparatus according to claim 1, wherein said apparatus comprises a shelf.

8. An apparatus according to claim 1, wherein said plurality of said first and second holding members are positioned in parallel.

9. An apparatus for displaying items, wherein said apparatus comprises first and second support devices, wherein said first support device includes a first holding member axially positioned therein and said second support device includes a second holding member axially positioned therein, wherein said first and second holding members are axially opposed to one another for securing said items, wherein at least one of said first or second support devices has positioned therein a compression spring adjacent to one end of said first or second holding member, and wherein said first and second holding members comprise golf tees.

10. An apparatus according to claim 9, wherein said apparatus comprises a plurality of said first and second support devices.

11. An apparatus according to claim 10, wherein said plurality of said first and second support devices are positioned in parallel.

12. An apparatus according to claim 10, wherein said plurality of said first and second support devices are positioned in parallel.

13. An apparatus according to claim 12, wherein said apparatus comprises a shelf.

14. An apparatus according to claim 9, wherein said apparatus comprises a base of a lamp.

* * * * *